United States Patent [19]

Ross

[11] 4,092,228

[45] May 30, 1978

[54] ELECTROLYTIC CELL

[75] Inventor: Francis Joseph Ross, Niagara Falls, N.Y.

[73] Assignee: E. I. Du Pont de Nemours and Company, Wilmington, Del.

[21] Appl. No.: 775,280

[22] Filed: Mar. 7, 1977

[51] Int. Cl.[2] ..... C25C 3/02; C25C 3/00

[52] U.S. Cl. ..... 204/68; 204/245; 204/246; 204/241

[58] Field of Search ..... 204/246–247, 204/68, 245

[56] References Cited

U.S. PATENT DOCUMENTS

| | | | |
|---|---|---|---|
| 2,944,950 | 7/1960 | Hayes | 204/68 |
| 3,201,229 | 8/1965 | Blue et al. | 204/68 X |
| 3,728,234 | 4/1973 | Sakai et al. | 204/68 |
| 3,962,064 | 6/1976 | Brut et al. | 204/246 |

*Primary Examiner*—John H. Mack
*Assistant Examiner*—D. R. Valentine

[57] ABSTRACT

The operating characteristics of a Downs-type electrolytic cell are improved by incorporating a sealed weir between the riser/cooler and the molten metal receiver and by providing means for venting inert gas from the receiver through the vapor space of the riser/cooler.

3 Claims, 1 Drawing Figure

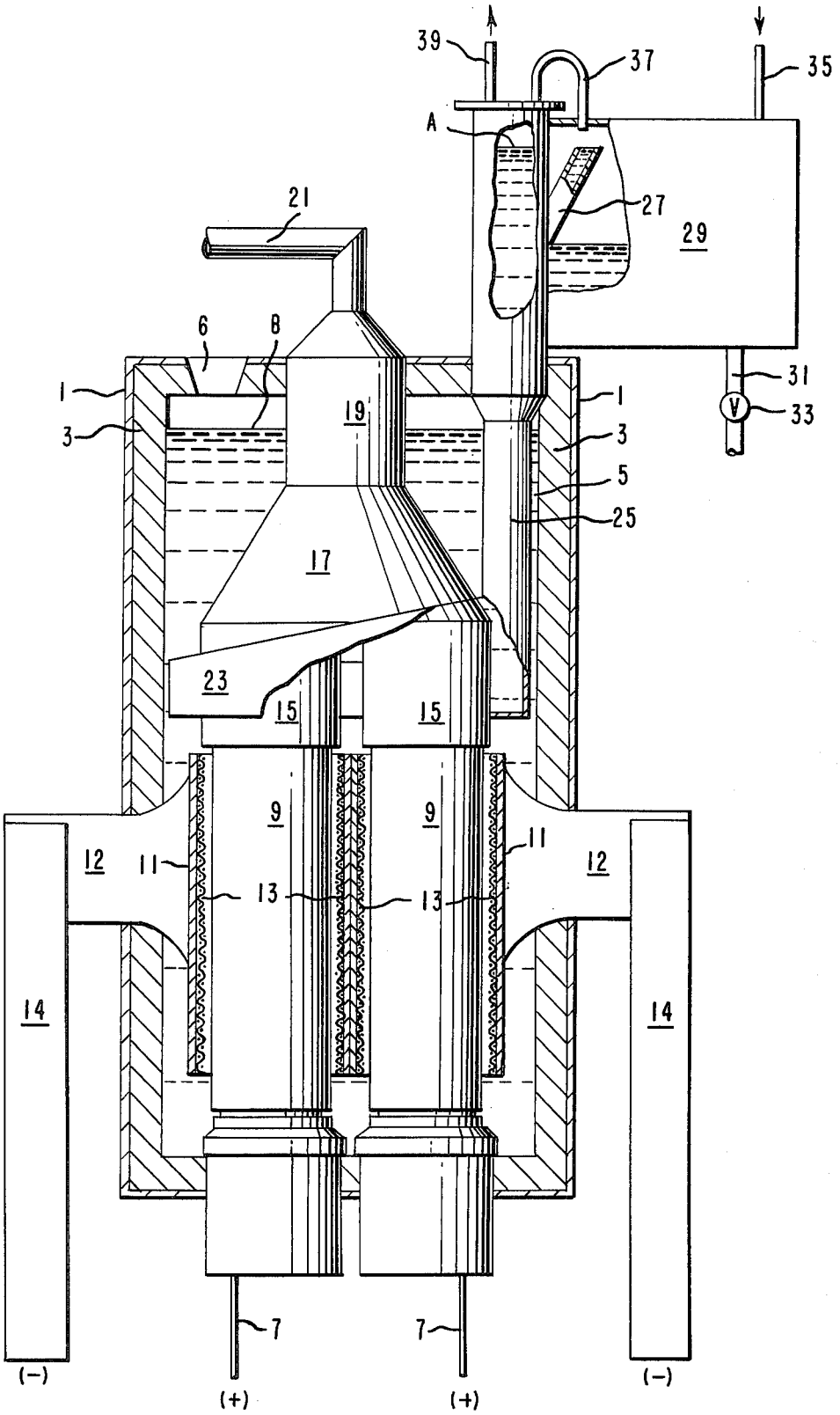
39
37
35
A
27
29
21
6
8
1
19
1
3
3
5
25
31
V
33
17
23
15
15
9
9
11
11
12
12
13
13
14
14
7
7
(−)
(+)
(+)
(−)

ELECTROLYTIC CELL

BACKGROUND OF THE INVENTION

The invention is directed to improvements in the construction of Downs-type electrolytic cells. In particular, it is directed to changes in the riser/cooler by which the operation of the cell is enhanced considerably.

A considerable proportion of the elemental alkali metals which are manufactured for commerce is produced by the electrolysis of molten halogen salts of the metals, especially eutectic mixtures of such salts with other salts which are substantially inert. For example, sodium metal can be produced by electrolysis of a molten binary eutectic mixture comprising calcium chloride and sodium chloride or a ternary eutectic mixture such as sodium chloride, calcium chloride and barium chloride. On the other hand, lithium metal is produced by electrolysis of a molten binary eutectic mixture comprising potassium chloride and lithium chloride.

The type of electrolytic cell most widely used for the above-described operations is the Downs cell, which is described in U.S. Pat. No. 1,501,756 to J. C. Downs. The Downs-type electrolytic cell basically is comprised of a refractory-lined steel shell for holding the molten salt electrolyte, a submerged cylindrical graphite anode surrounded by a cylindrical steel cathode and a perforated steel diaphragm positioned in the annular space between the electrodes to separate the anode and cathode products. To collect product halogen gas from the anode, the cell is provided with collector means such as an inverted cone which fits over the anode below the surface of the molten bath. Halogen gas (usually chlorine) passes upwardly through the cone and, via appropriate manifold components, from the cell. Similarly, the cathode is also provided with collector means such as an inverted inclined trough which fits over the cathode below the surface of the molten bath. Molten alkali metal rises from the cathode toward the surface of the molten bath, is collected along the inclined surface of the trough and is passed to a vertical riser/cooler in which the molten metal is partially cooled before it is passed to a product receiver. Commercial Downs cells frequently contain a plurality of electrode assemblies, in which case the anode product collectors are manifolded together to provide a single gas outlet from the cell. Usually, a common cathode product collector is provided which surrounds all of the gas collector cones. That is, the means for collecting the halogen gas is positioned within the perimeter of the molten alkali metal collector. Detailed illustrations and descriptions of such cells can be found in the following U.S. Patents:

| | | |
|---|---|---|
| R. E. Hulse | U.S. 2,130,801 | Sept. 20, 1938 |
| J. S. Honea | 2,770,364 | Nov. 13, 1956 |
| A. L. Fentress | 2,770,592 | Nov. 13, 1956 |
| G. O. Hoyes | 2,944,950 | July 12, 1970 |
| C. T. Gallinger | 3,037,927 | June 5, 1962 |
| G. T. Motock | 3,085,967 | April 16, 1963 |
| S. E. Eckert and F. J. Ross | 3,118,827 | Jan. 21, 1964 |
| J. M. Wood | 3,248,311 | April 26, 1966 |
| L. L. Harris | 3,463,721 | Aug. 26, 1969 |

In the past, the riser/cooler on Downs-type electrolytic cells has been comprised of a vertical tube rising from the upper end of inverted trough collector through which the molten metal rises by difference in gravity into the bottom of a molten product receiver or, alternatively, up to and over an open weir located at some predetermined higher level in the side of the riser/cooler so that the molten product spills over into the receiver. Though such arrangements have been satisfactory during normal cell operation, they have nevertheless presented serious problems of safety. More particularly, the prior art arrangement of open weirs or pipes between the riser and the receiver results in contamination of the inert gas-purged vapor space of the receiver whenever hydrogen or chlorine are produced inadvertently on the cathode side of the cell. This, of course, increases the amount of inert gas which must be used for operation of the cell and reduces the margin of safety in operation of the cell.

BRIEF SUMMARY OF THE INVENTION

It has now been found that the above-mentioned disadvantages of the prior art cells can be effectively overcome by modification of those means by which material is transferred between the riser/cooler and the receiver. In particular, the invention is directed to an improved Downs-type cell for the production of alkali metal by electrolysis of molten salts thereof having (1) means for the collection of gas from the anode positioned within the perimeter of (2) collector means for the removal of molten alkali metal to (3) a riser/cooler pipe through which molten alkali metal rises in non-turbulent flow by specific gravity difference to a predetermined level higher than the level of the molten halogen salt within the cell and flows into (4) an inert gas-blanketed receiver in which the molten metal is maintained in the molten state prior to removal from the cell, the improvement comprising in combination (a) a riser/cooler pipe having a conduit extending from below the level of molten metal within the riser/cooler pipe to a level within the receiver corresponding to the predetermined level of molten metal within the riser/cooler pipe, the riser/cooler pipe having a small vapor space above the molten metal level as compared with the vapor space of the receiver;

(b) an inert gas vent extending between the vapor space of the receiver and the vapor space of the riser; and (c) means for venting inert gas from the vapor space of the riser/cooler.

The invention is illustrated by the Drawing which consists of a single FIGURE which is a vertical cutaway section of a Downs-type electrolytic cell incorporating the improvements which comprise the invention.

The improved Downs-type cell which constitutes the invention can be used for the manufacture of any of the alkali metals by electrolysis of molten (fused) salts thereof. However, it is most likely to be used for either sodium or lithium and is, in fact, particularly advantageous for the manufacture of lithium.

Because the function of the riser pipe is both to cool and to purify the molten metal rising from the cathode, it will most often be preferred that the sealed weir be as high as possible consistent with the specific gravity difference between the separated metal and the molten bath of salt. By this means, the external surface for cooling is maximized and more of the salt and alloy impurities are thereby precipitated and settled out. The cooling capacity of the riser/cooler pipe is often augmented by the attachment of vanes to the exposed cooling surface. Furthermore, the lower temperature of the molten metal flowing into the receiver results in lower reactivity and therefore greater safety in the handling of molten metal from the receiver. Primarily for reasons of safety, it is preferred that the riser/cooler be equipped with an agitation device or "tickler" by which the salts, alloys and oxides which are precipitated therein can be prevented from plugging the riser pipe. Such devices are well known in the art and are described inter alia in U.S. Pat. Nos. 2,770,364, 2,770,592 3,037,927 and 3,463,721.

The sealed weir through which the molten metal is transferred to the receiver is comprised of a conduit extending from below the level of molten metal in the riser to a height in the receiver corresponding to the desired molten metal level in the riser. By using a closed or sealed weir of this type, the vapor space within the riser is isolated from the vapor space in the receiver. Thus, if a contaminating gas such as chlorine or hydrogen is produced in the cell and makes its way into the riser, it will be restricted to the riser vapor space and will not contaminate the vapor space in the receiver. Because the molten metal level within the riser will ordinarily be virtually constant, the vapor space above the molten metal in the riser will also be constant. Thus, by making the cross sectional area of the riser as small as possible, consistent with maintaining unconstricted laminar flow of metal therein, the amount of inert gas needed to purge the riser vapor space can be kept to a minimum.

A further related advantage is obtained by venting the purge gas from the vapor space of the receiver and the riser together. In particular, by maintaining a small continuous flow of gas from the receiver to a gas vent from the riser, the flow of any contaminant gas from the riser into the receiver is avoided. This can be accomplished by venting the receiver into the vapor space of the riser or by otherwise maintaining a positive pressure of gas in the receiver and venting the receiver purge gas into a common vent line.

In a preferred aspect of the invention, the intake level of the molten metal collector is positioned at a level in the cell bath higher than the intake level of the halogen gas collector. By this means, in the event the riser pipe becomes blocked to an extent that an underflow of molten metal is forced from the metal collector, the underflow of metal becomes safely diffused in the salt bath and does not enter the gas collector where it is likely to undergo violent reaction.

The invention is further exemplified in the Drawing, which consists of a single FIGURE.

Referring now to the Drawing, a Downs-type electrolytic cell is shown having a steel shell 1 lined with ceramic brick 3 containing a bath of molten salt 5 which has been charged to the cell in particulate solid form through loading port 6. An anodic bus bar 7 is connected electrically with each of a plurality of cylindrical graphite anodes 9. Surrounding each of the cylindrical anodes is a concentric steel cathode 11, which is connected electrically through cathode arm 12 with bus bar 14. In the annulus between the anode and cathode is positioned a steel screen diaphragm 13 which prevents mixing of the anode and cathode products. The cell shown in the drawing contains four symmetrically-positioned electrode assemblies of which only the front two appear in the view of the drawing. Gas formed at the surface of the anode passes upward between the diaphragm and the anode into collector ring 15 and then into gas collector cone 17. The gas is removed from the cell via gas dome 19 through gas outlet line 21 to storage or other disposition. It is customary to maintain a slight vacuum on the exit line in order to prevent seepage of halogen gas into the work areas in which the cells are located. Molten metallic alkali metal formed at the cathode rises upward by the force of gravity difference into molten alkali metal collector 23, which is in the shape of an inverted sloping trough. The molten alkali metal flows along the top of the metal collector and passes into the lower end of riser/cooler 25 in which it is cooled as it rises toward the top of the riser/cooler. The difference between the level of molten metal in the riser/cooler A and the level of molten salt in the main part of the cell B will be mainly a function of the difference in the specific gravities of the molten metal and the molten salt bath.

In the side of the riser/cooler is a sealed weir conduit 27, the top of which is positioned at a level corresponding to the level of metal required for the riser/cooler. Overflow through the sealed weir spills over into molten metal receiver 29 in which the metal can be cooled still further. The still molten alkali is removed periodically from the receiver for molding, storage, shipping, etc. via alkali metal outlet 31 through valve 33.

The receiver must, of course, be purged with a gas which is inert to the molten metal. This gas is admitted to the receiver through purge inlet 35. In order to maintain a slight positive pressure from the receiver to the vapor space of the riser/cooler, a small continuous flow of purge gas is maintained from the receiver to the vapor space of the riser/cooler via receiver vent line 37. Purge gas in the vapor space of the riser/cooler is then vented therefrom via purge vent line 39.

The technical suitability of gases which may be used as purge gases during the production of alkali metals depends, of course, upon their degree of inertness toward the particular metal being produced in the molten state at the operating temperature. Carbon dioxide is too reactive with both lithium and sodium. On the other hand, nitrogen is sufficiently inert to be used in the presence of sodium but is unsatisfactory for lithium because it tends to form insoluble nitrides. For this reason, one of the inert gases, i.e., the zero group gases, is preferred. Of these, argon is most widely used.

I claim:

1. In a Downs-type cell for the production of alkali metal by electrolysis of molten salts thereof having (1) means for the collection of gas from the anode positioned within the perimeter of (2) collector means for the removal of molten alkali metal to (3) a riser/cooler pipe through which molten alkali metal rises in non-turbulent flow by specific gravity difference to a predetermined level higher than the level of the molten salt within the cell and flows into (4) an inert gas-blanketed receiver in which the molten metal is maintained in the molten state prior to removal from the cell, the improvement comprising in combination (a) a sealed weir connected to the riser/cooler pipe at a point below the level of molten metal within the riser/cooler pipe and extending into the receiver to a level within the receiver corresponding to the predetermined level of molten metal within the riser/cooler pipe, the riser/cooler pipe having a small vapor space above the molten metal level as compared with the vapor space of the receiver;

(b) an inert gas vent extending between the vapor space of the receiver and the vapor space of the riser; and (c) means for venting inert gas from the receiver through the vapor space of the riser/cooler.

2. A process for the manufacture of alkali metals by electrolysis of molten salts thereof comprising carrying out the electrolysis in the electrolytic cell of claim 1 in which a flow of inert gas is maintained from the vapor space of the receiver to the vapor space of the riser/-cooler.

3. The electrolytic cell of claim 1 in which the intake level of the gas collector means extends to a level lower than the intake level of the molten metal collector means so that any underflow of molten metal from the molten metal collector passes into the molten salt bath outside the molten metal collector and not within the gas collector.

* * * * *